United States Patent [19]

Hikuma et al.

[11] Patent Number: 4,787,229

[45] Date of Patent: Nov. 29, 1988

[54] METHOD OF ROLLING A PIPE BY FLAT CUTTERS

[75] Inventors: Hideo Hikuma; Masaji Yamada, both of Hamamatsu, Japan

[73] Assignee: Fuji Tekko Co., Ltd., Shizuoka, Japan

[21] Appl. No.: 30,427

[22] Filed: Mar. 26, 1987

[30] Foreign Application Priority Data

Jul. 14, 1986 [JP] Japan ..... 61-165785

[51] Int. Cl.[4] ..... B21D 7/00; B21H 5/00

[52] U.S. Cl. ..... 72/88; 29/159.2

[58] Field of Search ..... 72/88, 90, 469, 95, 72/92, 102–104, 108; 29/159.2

[56] References Cited

U.S. PATENT DOCUMENTS

| | | | |
|---|---|---|---|
| RE14,759 | 11/1919 | Wilcox | 72/469 |
| 352,365 | 11/1886 | Simonds . | |
| 1,907,684 | 5/1933 | Thomson | 72/469 |
| 3,015,243 | 1/1962 | Drader | 72/469 |
| 3,214,951 | 11/1965 | McCardell | 72/88 |
| 3,453,185 | 7/1969 | Morse | 72/469 |
| 3,872,699 | 3/1975 | Blue . | |
| 4,028,922 | 6/1977 | Killop | 72/469 |
| 4,646,549 | 3/1987 | Saito et al. | 72/95 |

FOREIGN PATENT DOCUMENTS

| | | | |
|---|---|---|---|
| 18746 | 9/1967 | Japan | 72/103 |
| 209448 | 11/1984 | Japan | 72/469 |
| 1075723 | 7/1967 | United Kingdom . | |
| 1470783 | 4/1977 | United Kingdom . | |

*Primary Examiner*—Daniel C. Crane

*Attorney, Agent, or Firm*—Wenderoth, Lind & Ponack

[57] ABSTRACT

A method of rolling with flat cutters having finishing blades for rolling a periphery of a pipe. In working, the pipe is rotatably supported at both ends by a pair of centers, a pair of flat cutters which have a plurality of corrugated finishing blades formed on a substantially triangular blade base are disposed such that the finishing blades face each other and the directions of the finishing blades are parallel to an axis of the pipe, and the flat cutters are moved rectilinearly in opposite directions to each other from an initial working position to a terminal working position such that one end of each finishing blade presses the pipe. Thus, the periphery of the pipe is progressively worked axially from one end of the pipe.

6 Claims, 4 Drawing Sheets

METHOD OF ROLLING A PIPE BY FLAT CUTTERS

BACKGROUND OF THE INVENTION

The present invention relates to a method of rolling by flat cutters, and more particularly to a rolling method which comprises rolling a pipe to form splines, serrations or the like on its periphery by the flat cutters.

As a conventional rolling method, there is a rolling method as shown in FIGS. 1 to 3, for example.

As shown in FIG. 1, a workpiece 1 consisting of a solid rod is rotatably supported at the center of both ends by a pair of conical centers 2. Subsequently, the workpiece 1 is rolled on its periphery by means of a pair of longitudinally extending flat cutters 3 shown in FIG. 2. Each of the flat cutters 3 has a plurality of corrugated working blades 4 formed to extend laterally on an upper surface of the body, the working blades 4 consisting of rough blades 5, medium blades 6 and finishing blades 7, which gradually increase in height from an initial portion to a terminal in a longitudinal direction.

At the time of working, a pair of flat cutters 3, 3 are disposed with the working blades 4 thereof facing each other, so that a workpiece 1 is charged between them with its axis parallel to the blades 4. Then, both of the flat cutters 3 are moved rectilinearly in opposite directions towards each other so that the peripheral portion of the workpiece 1 can be rolled. Subsequently, as shown in FIG. 3, the rolled workpiece 1 is held by a chuck 8 and cored by a drill 9 to obtain a rolled pipe product.

In such a conventional rolling method, since a workpiece consisting of a solid rod is rolled on the periphery and subsequently the workpiece is cored by a drill, the working operation takes much time and the working procedures are complicated. For solving this problem, if a pipe is used as a workpiece, there would be a problem in that rolling with high accuracy would be difficult because the conventional flat cutter 3 has the working blades 4 formed horizontally throughout a width w (FIG. 2) of the cutter and the working blades 4 simultaneously press the portion of the workpiece to be rolled, resulting in deformation of the workpiece consisting of a pipe in the axial direction. In addition, in the conventional flat cutter 3, since the working blades 4 are formed horizontally throughot the width w, the working blades 4 are worn out evenly in the direction of width of the body. Therefore, it is difficult to extend the life of the cutter by reabrading the worn portion of the working blades.

SUMMARY OF THE INVENTION

An object of the present invention is to provide a rolling method by which, in the case of using a pipe as a workpiece, a force applied by the blades of a flat cutter is reduced to prevent deformation of the pipe and hence the pipe can be rolled with high accuracy.

Another object of the invention is to provide a method of rolling a pipe by which a well finished product can be obtained without pressing the portion to be rolled by the flat cutters and the centers.

Another object of the invention is to provide a rolling method using flat cutters which permit extension of the life of the cutter by easily reabrading the worn portion of the working blades.

These and other objects, features and advantages of the invention will become apparent from the following description taken in connection with the accompanying drawings.

DESCRIPTION OF THE PREFERRED EMBODIMENTS

FIGS. 4 to 8 are views illustrating a rolling method according to the present invention.

Figure 1:
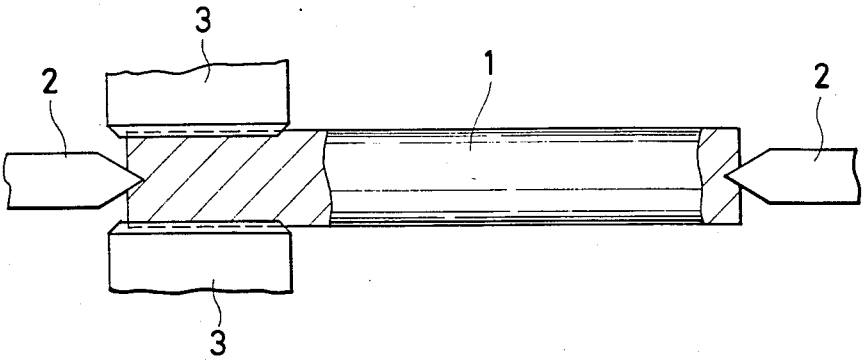
FIG. 1 PRIOR ART
FIGS. 1 to 3 are views illustrating a rolling method according to the conventional flat cutters.
Figure 2:
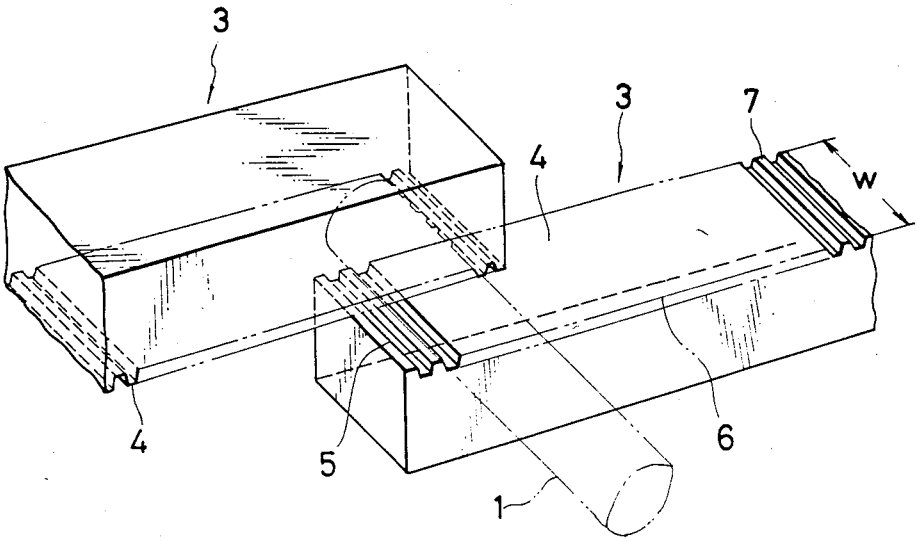
FIG. 2 PRIOR ART
Figure 3:
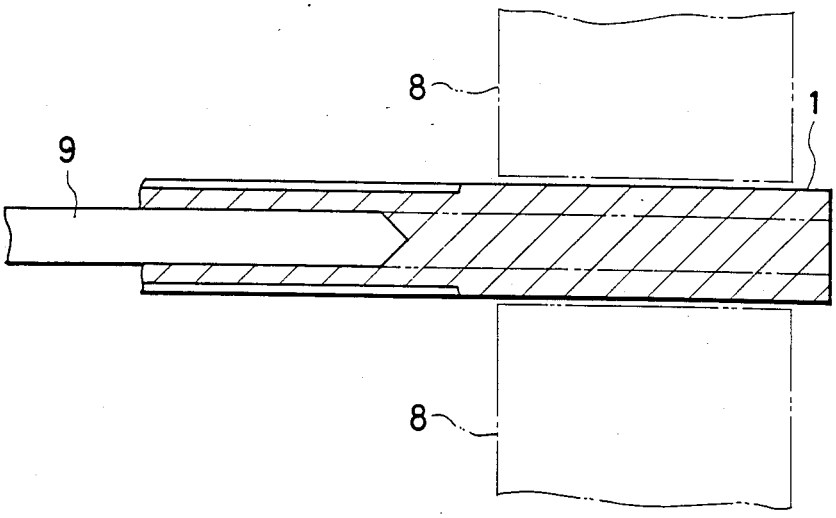
FIG. 3 PRIOR ART
Figure 4:
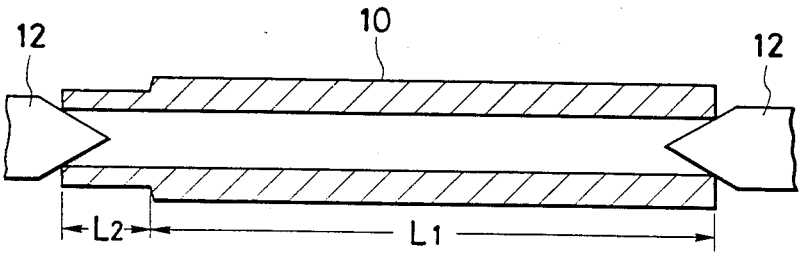
FIG. 4 is a sectional view illustrating a state in which a pipe is set between a pair of centers according to the rolling method of the present invention.

As shown in FIG. 4, a pipe 10 used as a workpiece is supported rotatably at both ends by a pair of centers 12, 12. In this case, the length of the pipe 10 is a sum of the length $L_1$ of the final product and the length $L_2$ of a portion required for engagement of the center 12 on the axial end to be rolled, the outer diameter of the portion of the length $L_2$ being formed somewhat smaller than that of the portion to be rolled so as to prevent contact with finishing blades of flat cutters 14 described later.

Figure 5:
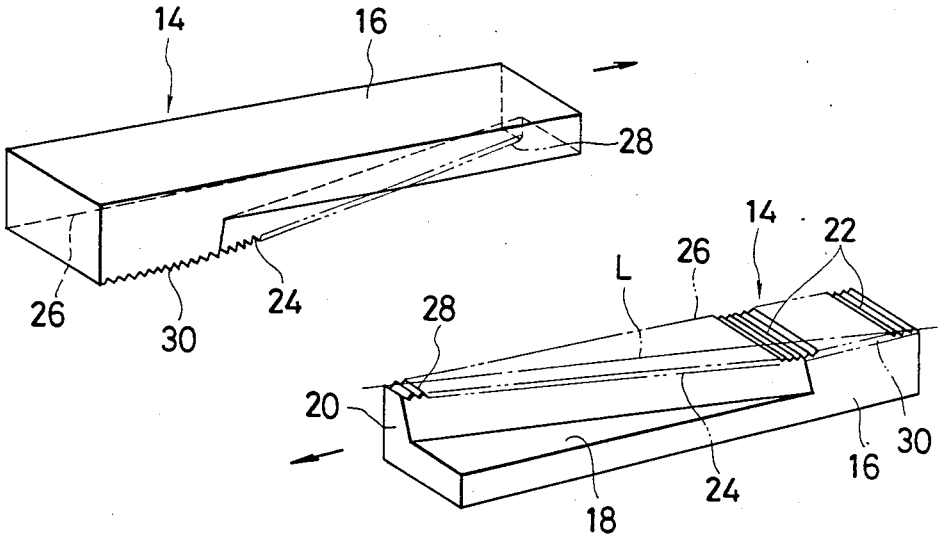
FIG. 5 is a perspective view illustrating a pair of flat cutters used in the present invention.

Next, the periphery of the pipe 10 is rolled by a pair of flat cutters 14, 14 used on the upper and lower sides thereof, as shown in FIG. 5. Each of the flat cutters 14 used herein comprises a rectangular solid body 16 which has an upper surface or a lower surface divided by a straight line parallel with a diagonal L of the rectangle into a triangular recess 18 formed lower by a step on one side (lower side in the drawing) and a higher blade base 20 formed on the other side, on which base 20 a plurality of corrugated working blades 22 are formed such that the narrowest part of the base comprises an initial working part and the widest part of the base comprises a terminal working part, the blades extending in the direction of width. The working blades 22 consist of finishing blades which are inclined with respect to the axis of the workpiece, the blades being inclined to be lower than a horizontal surface by a few degrees (transverse relief angle $\beta = 1°$ to $2°$) from an end 24 on the recess side of the blade base 20 to another end 26 on the opposite side.

The rolling by the above-mentioned flat cutters 14 is as follows.

Figure 6:
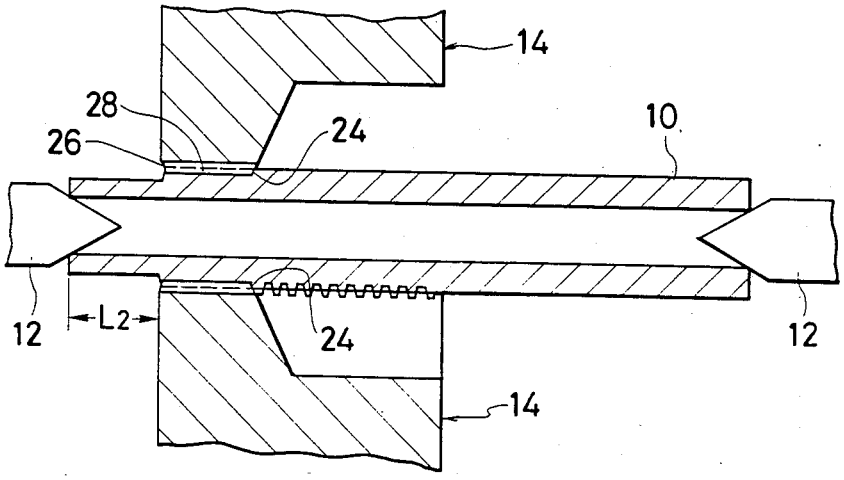
FIG. 6 is a sectional view illustrating the initial state of the rolling.
Figure 7:
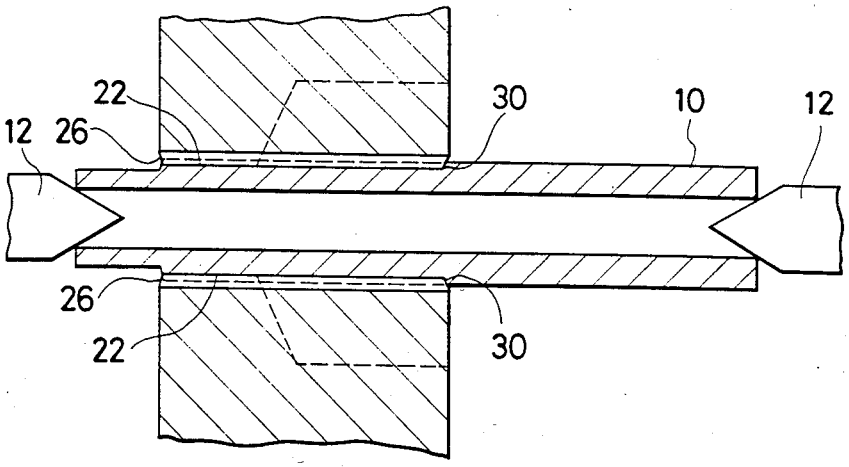
FIG. 7 is a sectional view illustrating the final state of the rolling.
Figure 8:
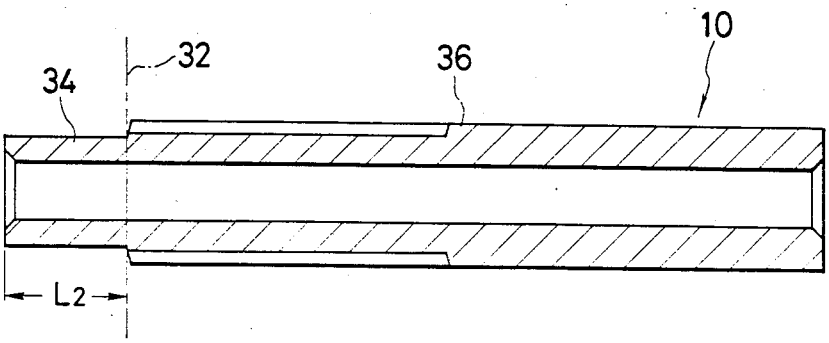
FIG. 8 is a view illustrating a process in which the ends of the pipe are cut off to form a product.

First, as shown in FIG. 6, a pair of flat cutters 14, 14 are disposed so that the initial points of the working blades 22, i.e. blade portions 28 short in width are facing each other, and a pipe 10 having its axis parallel with the working blades 22 is engaged between the blade portions. At this time, the flat cutters 14 are positioned against the pipe 10 with a gap of the above length $L_2$ between the cutters and the left end of the pipe 10. Then, the pair of cutters 14 in this state are moved rectilinearly with respect to each other from the initial working part 28 to the terminal working part 30 of the cutters in opposite directions to roll the pipe 10 until the maximum width of the working blades 22 as shown in FIG. 7 has worked the workpiece.

Thus, at the beginning of the rolling, the initial working part 28 short in width of the working blades 22 of the pair of flat cutters 14 presses to work an end of the pipe 10. Next, with the advance of the flat cutters 14, the end 24 of the working blades 22 facing the recess 18 gradually moves in an axial direction of the pipe 10 to work the peripheral portion of the pipe 10 axially. Accordingly, a force applied to the pipe 10 by the working blades 22 becomes smaller than a force applied by the wider working blades of the conventional cutter, so that deformation of the pipe can be prevented.

In addition, since the end 24 of the working blades 22 facing the recess 18 is parallel to the opposite end 26 at the terminal working part 30 of each of the flat cutters 14, that is, the increasingly wider end 24 merges with the terminal working part 30 which extends in a direction perpendicular to the axis of the pipe 10, an axially inside portion of the pipe 10 can be worked equally in level by the end 30.

Since the upper surfaces of the working blades 22 of each flat cutter are at a tranverse relief angle $\beta$, the pipe 10 is worked mainly by the lateral ends 24 and 30 of the respective working blades 22, facing the recess 18, and the other portions of the working blades hardly contact the pipe, resulting in little wear. Therefore, if the lateral ends 24 and 30 on the recess side of the cutter have been worn, then it is possible to reform new finishing blades by abrading the recess facing side of the blade base 20 and the terminal working part of the body 16.

Lastly, the rolled pipe 10 is cut at a position spaced by a distance $L_2$ from the left end along the line perpendicular to the axis to remove the left end portion 34, so that a product 36 is formed. Thus, an excellent rolled pipe product can be obtained having a worked portion which has never been pressed by the flat cutters and the centers.

While preferred embodiments have been described, the present invention is not limited thereto but rather, many modifications may be made thereto which fall within the scope of the appended claims.

What is claimed is:

1. A method of rolling a pipe with flat cutters, which comprises rotatably supporting a pipe at both ends by a pair of centers, engaging an outer periphery of said pipe with a pair of flat cutters having a plurality of corrugated working blades on a substantially triangular blade base which is narrowest at one longitudinal end thereof and widest at the other longitudinal end thereof with the finishing blades of both cutters facing each other and extending in a direction parallel to a central axis of said pipe, and moving said flat cutters rectilinearly in opposite directions while pressing said pipe starting with an initial working portion of the respective finishing blades and ending with a terminal working portion of the respective finishing blades, said initial working portion of the respective finishing blades being located at the narrowest portion of the triangular blade base and the terminal working portion of the respective finishing blades being located at the widest portion of the triangular blade base.

2. A method of rolling according to claim 1, wherein said pressing is started with said pair of flat cutters being positioned axially along said pipe with a gap between a portion of said pipe to be worked and one of said ends of said pipe rotatably supported by a respective one of said centers.

3. A method of rolling according to claim 1, wherein said finishing blades are formed such that a plane containing top surfaces thereof is inclined with respect to said central axis of said pipe at a predetermined transverse relief angle such that said pipe is only worked by one end of each finishing blade which thereby gradually forms corrugations on said outer periphery progressively and axially along said pipe.

4. A method of rolling according to claim 2, further comprising cutting said pipe to remove a section thereof at which said gap is located after working of said pipe by said cutters has been completed.

5. A method of rolling according to claim 1, further comprising forming a stepped portion of reduced diameter at one axial end of said pipe prior to rotatably supporting said pipe by said centers, and working said pipe with said cutters axially inwardly of said stepped portion.

6. A method of rolling a tubular member having a stepped portion of smaller diameter at one axial end thereof by flat cutters, each of which comprises a rectangular cutter body, a substantially triangular blade base portion which is formed as a higher step with a lateral side thereof extending along a straight line parallel with a diagonal on one side of a plane of said cutter body and a plurality of corrugated finishing blades which are formed on an upper surface of said blade base portion and extend laterally in a direction parallel to a central axis of the tubular member, the central axis being perpendicular to a rolling direction of a workpiece upon rolling machining, wherein said finishing blades are formed in a manner such that upper surfaces thereof are inclined at a predetermined transverse relief angle so that heights of the blades become lower with respect to the central axis from one end thereof along said lateral side of said blade base portion to the other end thereof on an opposite lateral side of said blade base portion, and a pair of said rolling flat cutters are arranged such that the blade base portions face each other, the method comprising the steps of:

rotatably supporting the tubular member to be worked at both ends by a pair of centers, aligning the flat cutters axially inwardly of the stepped portion of the tubular member with the blades of the cutters extending parallel to the central axis of the tubular member and arranging the tubular member between said opposite blade base portions; and moving said pair of flat cutters rectilinearly in opposite directions while pressing the tubular member from a position at which an initial working part of each of the cutters is in contact with the tubular member to a position at which a terminal working part of each of the cutters is in contact with the tubular member to thereby form splines on an outer periphery of the tubular member which extend in a direction parallel to the central axis of the tubular member.

* * * * *